United States Patent [19]

Lupova et al.

[11] 4,456,544

[45] Jun. 26, 1984

[54] ENZYME-CONTAINING DETERGENT COMPOSITION FOR PRESTERILIZATION TREATMENT OF MEDICAL INSTRUMENTS AND EQUIPMENT

[75] Inventors: Ljudmila M. Lupova; Lidia G. Fedorova; Renata N. Grebeshova; Zinaida P. Aleshina; Alexandr G. Anton; Alexandr L. Belinsky; Margarita I. Alexeeva, all of Moscow, U.S.S.R.

[73] Assignee: Vsesojuzny Nauchno-Issledovatelsky Biotecknichesky Institut, Moscow, U.S.S.R.

[21] Appl. No.: 520,813

[22] Filed: Aug. 5, 1983

[51] Int. Cl.[3] ..... C11D 1/94; C11D 7/42; C11D 17/00

[52] U.S. Cl. ..... 252/174.12; 252/109; 252/DIG. 12; 422/88; 435/174; 435/175; 435/188; 435/202; 435/218; 435/264

[58] Field of Search ..... 252/174.21, DIG. 12, 252/109; 435/264, 188, 202, 218, 219, 174, 175; 422/88

[56] References Cited

U.S. PATENT DOCUMENTS

| | | | |
|---|---|---|---|
| 3,278,390 | 10/1966 | Arthur | 435/264 |
| 3,451,935 | 6/1969 | Roald et al. | 252/135 |
| 3,573,170 | 3/1971 | Clark et al. | 435/202 |
| 3,629,123 | 12/1971 | O'Reilly et al. | 252/DIG. 12 |
| 3,753,915 | 8/1973 | Demangeon | 252/DIG. 12 |
| 3,985,686 | 10/1976 | Barrat | 252/DIG. 12 |
| 4,142,999 | 3/1979 | Bloching et al. | 252/544 |

FOREIGN PATENT DOCUMENTS

| | | |
|---|---|---|
| 2259201 | 6/1974 | Fed. Rep. of Germany . |
| 1576946 | 10/1980 | United Kingdom . |
| 2081295 | 2/1982 | United Kingdom . |

*Primary Examiner*—John E. Kittle
*Assistant Examiner*—Mukund J. Shah
*Attorney, Agent, or Firm*—Ladas & Parry

[57] ABSTRACT

An enzyme-containing detergent composition for a presterilization treatment of medical instruments and equipment, consisting of the following components, percent by weight:

anionic surfactants: 4.0–6.0
sodium phosphate: 30.0–35.0
sodium silicate: 20.0–25.0
sodium carbonate: 19.0–22.0
soap comprising sodium salts of fatty acids: 2.0–4.0
enzymatic preparation: 0.5–2.0
sodium sulphate: the balance, the enzymatic preparation having the following composition, percent by weight:

alkaline protease: 30–60
neutral protease: 27–45
elastase: 0.01–5.00
collagenase: 0.001–4.00
leucinaminopeptidase: 0.0001–0.011
carboxypeptidase: 0.04–0.15
fibrinolytic enzyme: 0.002–1.500
lipase: 0.5–2.0
amylase: the balance.

3 Claims, No Drawings

ENZYME-CONTAINING DETERGENT COMPOSITION FOR PRESTERILIZATION TREATMENT OF MEDICAL INSTRUMENTS AND EQUIPMENT

FIELD OF THE INVENTION

The present invention relates to enzyme-containing detergent compositions useful for presterilization treatment of medical instruments and equipment.

Such detergent compositions are employed for the removal of protein-nature contaminations (blood, tissue remnants) from the surface of medical instruments and equipment.

BACKGROUND OF THE INVENTION

Enzyme-containing detergent compositions generally comprise surfactants, sodium phosphate, sodium silicates, sodium carbonate, sodium sulphate, and enzymatic preparations. The latter usually comprise several components, most frequently an alkaline protease and amylase. In a detergent solution these enzymatic preparations become rapidly inhibited and fail to sufficiently hydrolyze protein contaminations. Unsatisfactorily washed surgical instruments still containing blood and tissue remnants on their surface can become the cause of pyo-septic complications during the post-operation period. Enzyme stabilizers are incorporated into enzyme-containing detergent compositions to prevent the above-mentioned phenomenon of inhibition. The incorporation of stabilizers complicates the procedure of preparing a detergent composition and increases its cost.

It is known to use hydrogen peroxide in combination with detergents. Hydrogen peroxide makes it possible to removal all protein contaminations, but brings about corrosion of metal surfaces of the instruments, wherefore expensive instruments and equipment made from special alloys and carbon steel have but a short service life.

A number of enzyme-containing detergent are known in the art. Thus, a washing composition is known for the removal of protein contaminants from the process equipment prior to sterilization thereof (cf. U.S. Pat. No. B-458,819 Cl.252-545). This composition comprises an anionic surfactant, water-soluble inorganic phosphates, sodium metasilicate, sodium carbonate, an enzymatic preparation, an alkaline protease. Sodium chloride or sodium sulphate, as well as polyhydric alcohols are used as stabilizers for the enzyme. An alkaline protease is present in the detergent composition in an amount ensuring proteolytic activity of the composition up to 500–1,000 Delft units/g.

This composition does not provide complete elimination of complex protein contaminants (blood and tissue remnants) from medical instruments. Furthermore, in this composition enzymes have an insufficient stability. To preserve the enzyme activity, stabilizing agents should be incorporated in the composition.

Known in the art is another enzyme-containing detergent composition based on surfactants (cf. French Patent No. 2,371,510 Cl C 11 D). The composition incorporates an alkaline protease and/or amylase. The enzymatic preparation has the alkaline protease activity of 1,000–1,500,000 units/g and amylase activity of 10–10,000 units/g.

This enzyme-containing detergent composition does not make it possible to remove all protein contaminants from medical instruments and equipment due to a limited set of enzymes. Furthermore, the enzymes are of an insufficient stability, and therefore they have to be incorporated in the detergent composition in large amounts.

Also known is an enzyme-containing detergent composition incorporating non-ionic surfactants, an alkaline protease and amylase; the enzyme-containing detergent composition has the protease activity of 1 kg as expressed in Anson units and amylase activity of 150 Kilo Novo units (cf. French Patent No. 2,355,908 Cl. C 11 D). This enzymatic detergent composition cannot ensure effective elimination of protein contaminations from medical instruments either.

A still another enzyme-containing detergent composition is known, intended for cleaning process equipment contaminated with protein or starch. The composition contains non-ionic and anionic surfactants, in particular, sodium dodecylbenzosulphonate, sodium tripolyphosphate and/or sodium gluconate, sodium silicate, sodium carbonate, sodium sulphate, and an enzymatic preparation. The latter contains an alkaline protease and amylase. This composition also incorporates stabilizing agents for the protease. As such stabilizing agents use is made of polyethylene glycols, calcium chlorides, citrates and acetates. Sodium chlorides, citrates and acetates are used as stabilizing agents for amylase. The composition also contains defoaming agents such as a fatty acid diethanolamide (FRG Application No. 2,259,201 Cl. 23 e 2).

This detergent composition does not ensure cleaning of medical instruments from such hardly-removable contaminations as blood and tissue remnants due to the presence of only two enzymes-alkaline protease and amylase therein. Furthermore, protease and amylase are insufficiently stable. To ensure adequate efficiency of these enzymes, stabilizing agents should be added into the detergent composition. This complicates the procedure for the preparation of the enzyme-containing detergent composition and increases its cost of production.

SUMMARY OF THE INVENTION

It is an object of the present invention to provide such an enzyme-containing detergent composition for presterilization treatment of medical instruments and equipment, which would ensure full elimination of protein and fat contaminations from the medical instruments and equipment without causing corrosion and would be economically efficient.

These and other objects are accomplished by the provision of an enzyme-containing detergent composition for presterilization treatment of medical instruments and equipment, which comprises anionic surfactants, sodium phosphates, sodium silicates, sodium carbonate, sodium sulphate and an enzymatic preparation containing an alkaline protease and amylase and which contains, according to the present invention, a soap comprising sodium salts of fatty acids, while the enzymatic preparation containing also a neutral protease, elastase, collagenase, leucinaminopeptidase, carboxypeptidase, a fibrinolytic enzyme and lipase in the following proportions of the enzymatic preparation components, percent by weight:

alkaline protease: 30–60
neutral protease: 27–45
elastase: 0.01–5.00 collagenase: 0.001–4.00
leucinaminopeptidase: 0.0001–0.011
carboxypeptidase: 0.04–0.15
fibrinolytic enzyme: 0.002–1.500
lipase: 0.5–2.0
amylase: the balance, the enzyme-containing detergent composition having the following proportions of the components, percent by weight:

anionic surfactants: 4.0–6.0
sodium phosphate: 30.0–35.0
sodium silicate: 20.0–25.0
sodium carbonate: 19.0–22.0
soap comprising sodium salts of fatty acids: 2.0–4.0
enzymatic preparation: 0.5–2.0
sodium sulphate: the balance.

As the anionic surfactants it is advisable to use a sodium alkylbenzenesulphonate based on kerosene, n-paraffins, propylene tetramers, α-olefins or alkylsulphates.

The presence of anionic surfactants in the detergent composition in an amount of 4.0 to 6.0% by weight ensures washing standard contaminations off the various objects due to a reduced surface tension at the interface of a water-washed object.

As sodium phosphates it is possible to use, for example, sodium tripolyphosphate, trisodium phosphate, tetrasodium pyrophosphate.

The presence of sodium phosphates in the enzyme-containing detergent composition in an amount of 30.0–35.0% by weight ensures softening of water, peptizing effect in respect of hydrophilic contaminations, prevents hygroscopicity and aggregation of the detergent composition. The use of phosphates in an amount above 35% by weight is undesirable due to contamination of waste waters; the use of sodium phosphate in an amount below 30% in the enzyme-containing detergent composition does not ensure sufficient cleaning.

Sodium silicates can be exemplified by sodium silicate as such, sodium metasilicate, hydrated sodium sesquisilicate, and concentrated sodium orthosilicate. The presence of silicates in the detergent composition in an amount of 20.0–25.0% by weight prevents medical instruments and equipment from corrosion upon cleaning and enables prevention of aggregation of the final detergent composition. The use of sodium silicates in an amount below 20.0% by weight does not ensure protection of medical instruments and equipment from corrosion, while the use of this component in an amount above 25.0% by weight results in inhibition of enzymes in the detergent composition.

Incorporation of sodium carbonate in an amount of 19.0–22.0% by weight into the enzyme-containing detergent composition creates an alkaline medium ensuring most efficient elimination of contaminations.

An amount of this component above 22.0% by weight is undesirable, since this results in reduced activity of the enzymatic preparation, while its use in an amount below 19.0% by weight causes reduced proteolytic activity of the composition.

The presence in the enzyme-containing detergent composition of a soap comprising sodium salts of fatty acids in an amount of 2.0 to 4.0% by weight reduces foaming in the case of machine-washing of medical instruments.

The soap is a final product obtained by a conventional process such as saponification of vegetable oils and animal fats with caustic soda or calcined soda. In addition to vegetable and animal fats for the production of soap fat substituents are used which are synthetic acids with a number of carbon atoms from 13 to 18, naphthenic acids, rosin, tall oil which is a waste product in the production of cellulose.

Sodium sulphate is a filler in the detergent composition according to the present invention.

As it has been mentioned above, the enzymatic preparation comprises a complex of compounds. It incorporates seven proteolytic enzymes (proteases) ensuring hydrolysis of various protein contaminations. Out of these seven proteases five are stable in an alkaline medium. These five proteases are the following: an alkali protease, elastase, collagenase, leucinaminopeptidase, carboxypeptidase. They ensure stability of the enzymatic preparation at pH of 10.5–11.5. Lipase incorporated in the enzymatic preparation contributes to hydrolysis of fat contaminations on the surface of medical instruments and equipment. Amylase also facilitates hydrolysis of carbohydrate contaminations on medical instruments.

The total content of the enzymatic preparation in the enzyme-containing detergent composition according to the present invention ranges from 0.5 to 2.0% by weight. The alkaline protease activity is 1,000 FOLP units/g of the composition (the procedure of determination of a proteolytic activity by the FOLP method is described hereinbelow).

It is advisable that the enzyme-containing detergent composition of the present invention should incorporate non-ionic surfactants in an amount of 1–2% by weight of the amount of anionic surfactants for enhancing its cleaning power.

As the non-ionic surfactants it is possible to use, e.g. a monoalkyl ester of polyethylene glycol based on primary aliphatic alcohols $C_nH_{2n+1}O(C_2H_4O)_mH$, wherein n=10–18, m=8–10; polyoxyethylene glycol ester of monoethanolamides of synthetic fatty acids $C_nH_{2n+1}$ $CONHCH_2CH_2O(C_2H_4O)_mH$, wherein n=10–16, m=5–6.

The use of non-ionic surfactants in the above-specified amounts enhances the washing effect of anionic surfactants. They are used in the case of hardly-removable protein and fat contaminations from the surface of medical instruments and equipment.

Known in the art is the use of anionic and non-ionic surfactants, as well as sodium phosphates and silicates, sodium carbonate, an enzymatic preparation and sodium sulphate in enzyme-containing detergent compositions. However, none of these agents ensures complete elimination of protein and fat contaminants from medical instruments and equipment. This is due to the fact that anionic surfactants and sodium phosphates inhibit, to some extent, activity of enzymatic preparations. Sodium silicates and sodium carbonate exert the strongest inhibition effect on enzymatic preparations (up to 20–40%). Only the use of the enzyme-containing detergent composition according to the present invention containing known components in predetermined proportions ensures complete elimination of protein and fat contaminations, since only with this selection of the components and proportions thereof the surfactants, sodium phosphates and silicates, sodium carbonate and sodium sulphate do not substantially inhibit the enzymatic preparation and ensure high characteristics of its stability and efficiency.

The enzyme-containing detergent composition for presterilization treatment of medical instruments and equipment includes a wide range of enzymes.

Owing thereto, the enzyme-containing detergent composition is highly efficient in washing protein and fat contaminants from the surface of medical instruments and equipment. Thus, this composition makes it possible to ensure 100% elimination of blood, tissue remnants and other contaminations both in manual and machine washing. Purity is controlled by the orthotoluidine test.

As has been already mentioned above, the enzymatic preparation according to the present invention incorporates seven proteolytic enzymes: an alkaline protease, elastase, collagenase, leucinaminopeptidase, a fibrinolytic enzyme. This diverse set of proteases makes it possible to provide deep and full hydrolysis of various kinds of protein contaminations, mainly blood, to water-soluble aminoacids and peptides which are easily removable by means of a washing solution.

The presence in the enzyme-containing detergent composition of alkali-resistant proteases imparts high alkali-resistance to the enzyme-containing detergent composition according to the present invention at pH of 10.5–11.5. Owing thereto, the enzyme-containing detergent composition has high stability in manufacture (100%), lasting storage (95–100%) and in solution (85–92%). Furthermore, the enzyme-containing detergent composition according to the present invention has a sufficiently high proteolytic activity—1,000 FOLP units/g, which corresponds to 4,500 Delft units/g. Owing to the high stability and activity of the detergent composition, its consumption is reduced by 4–500 times as compared to known compositions.

The enzyme-containing detergent composition according to the present invention retains its activity for a long time, wherefore it does not require any stabilizers therefor, thus simplifying the process of its manufacture and considerably reducing production costs. Furthermore, the use of hydrogen peroxide causing corrosion of medical instruments and equipment is avoided.

The content of phosphates in the enzyme-containing detergent composition according to the present invention is substantially lower than in prior art compositions which is also an advantage, since an increased content of phosphates provides a detrimental effect on activity and stability of an enzymatic preparation and facilitates an active growth of algae in water pools.

A slightly increased content of sodium silicates as compared to known detergent compositions ensures protection of metal surfaces of medical instruments and equipment from corrosion upon treatment thereof with the enzyme-containing detergent composition according to the present invention.

DETAILED DESCRIPTION OF THE INVENTION

The process for producing an enzyme-containing detergent composition for presterilization treatment of medical instruments and equipment according to the present invention is simple and can be performed in the following manner.

According to one embodiment, raw materials are charged into a reactor-mixer in the following order: a soap, surfactants, water, sodium carbonate, sodium sulphate, sodium phosphates, sodium silicates.

In the case of use of non-ionic surfactants these are charged into the reactor-mixer together with anionic surfactants. The components are metered by means of automatic dispensing devices.

During the supply of the starting materials into the reactor the components are continuously intermixed and the mixture is heated to a temperature of 80°–90° C. by hot water circulating in a water jacket of the reactor-mixer. After charging of all the components the resulting mass is agitated for additional 10–15 minutes, whereafter it is delivered to atomization. The latter is effected in a plant of the "Lurgi" or "Kestner" type. Drying of the mass is carried out either cocurrently or countercurrently. The incoming gases have temperature of 250°–420° C. drying temperature is 150°–180° C. Thereafter the resulting powder is fed into an ager bin. From the ager bin the powder is supplied, through a feeder and band-type weight-metering device, into a mixing drum. An enzymatic preparation is simultaneously fed into this mixing drum through a metering device. From the mixing drum the ready enzyme-containing detergent composition is fed into bins for small- and large-volume packing through a system of conveyor mechanisms.

According to another embodiment, dry components are charged into a drum-type mixer in the following sequence: sodium phosphates, sodium carbonate, surfactants, powder-like soap, sodium sulphate, sodium silicate and enzymatic preparation.

Agitation and intermixing of the components is carried out for 20 minutes.

On completion of mixing the enzyme-containing detergent composition is discharged, by means of a scraper-type conveyor, into a bin, wherefrom the ready enzyme-containing detergent composition is delivered to an automated packing unit.

Procedure for determination of proteolytic activity (FOLP method)

The proteolytic activity characterizes the ability of an enzymatic preparation to catalyze proteolysis to peptides and aminoacids; it is expressed in units of protease in 1 g of the preparation.

As a proteolytic activity unit such an amount of an enzyme is assumed which catalyzes hydrolysis of 1 g of a protein (casein) under strict standard conditions: at the temperature of 40° C., pH of 10.5 and hydrolysis duration of 1 hour.

Preparation of a solution of an enzyme-containing detergent composition

From an average sample 100 g of an enzyme-containing detergent composition are taken and friturated in a mortar. 10 g of the enzyme-containing detergent composition are dissolved in distilled water and the solution volume is brought to 500 ml. A number of dilutions are made from the resulting solution (1:10, 1:5, 1:4, and the like).

In the analyzed solutions the amount of the enzyme-containing detergent composition calculated for 2 ml of the reaction mixture should not exceed 3 mg.

Preparation of a 1% solution of casein (substrate)

2 g of casein powder are placed into a 300 ml conically shaped flask and added with 140 ml of a carbonate-bicarbonate buffer with the pH of 10.7. The flask is put on a magnetic shaker and the solution is stirred for 30 minutes. Thereafter, still under stirring, the flask with the substrate is placed on a water bath at the temperature of 70° C. to ensure complete dissolution and the substrate is heated to the temperature of 40° C.; concentration of hydrogen ions (pH) at this temperature is brought to 10.5 by addition (when required) of a 1N solution of sodium hydroxide (NaOH). Then the solution of the substrate from the conically shaped flask is transfered into a 200 ml metering flask and brought to a volume of 180–190 ml by means of a 0.2M solution of the carbonate-bicarbonate buffer. Thereafter the solution of casein is cooled with running water to the temperature of 20° C. and the substrate volume is brought to 200 ml using a 0.2M solution of the carbonate-bicarbonate buffer. The period of storage of the substrate in a refrigerator is not more than 2 days.

Preparation of a 0.2M solution of the carbonate-bicarbonate buffer with the pH of 10.7

For the preparation of the carbonate-bicarbonate buffer 45 ml of a 0.2M solution of sodium carbonate $Na_2CO_3$ and 5 ml of a 0.2M solution of sodium bicarbonate $NaHCO_3$ are charged into a 200 ml metering flask and the volume is brought to the mark with distilled water.

Preparation of Folin's solution

To prepare a basic Folin's solution, 700 ml of distilled water are poured into a 1,500 ml flask, added with 100 g of sodium tungstanate and 25 g of sodium molybdate. Then the mixture is added with 50 ml of 85% orthophosphoric acid (specific gravity of 1.689) and 100 ml of concentrated hydrochloric acid.

The mixture is heated at reflux on a low flame for 10 hours. 150 g of lithium sulphate, 50 ml of distilled water and 4–5 drops of liquid bromine are added to the cooled mixture. To remove the excess of bromine, the mixture is reflaxed on a low flame for 15–20 minutes. The solution is stored in a dark-glass flask in a refrigerator. After 2–3 months of storage one-two drops of bromine should be added to the solution which is then boiled again. Turbidity of the solution or its colour change from yellow to green is a sign of insuitability of the solution.

A working solution is prepared from the basic solution by way of dilution thereof with water in the ratio of 1:3 prior to the analysis.

Procedure for determination of proteolytic activity

Into test-tubes with a height of 150–180 mm and diameter of 15–18 mm the substrate is poured in portions of 5 ml, then kept in an ultrathermostat at the temperature of 40° C. for 5 minutes. Into the first test-tube 2.5 ml of distilled water are added, the time is noted, the contents are stirred and kept in the ultrathermostat for 60 minutes at the temperature of 40° C. Into other test-tubes 2.5 ml portions of solution of the enzyme-containing detergent composition of the above-specified dilutions are added, time is noted again, the contents are thoroughly stirred and set for hydrolysis for 60 minutes at the temperature of 40° C.

On expiration of the hydrolysis time (60 minutes) 5 ml of a 0.3M solution of trichloroacetic acid are added into each of the test-tubes starting with the first one (control) to stop the fermentative reaction and precipitate the unhydrolyzed protein (casein). The mixture is vigorously intermixed and kept in an ultrathermostat for 15 minutes at the temperature of 40° C. to ensure complete precipitation.

Then the solutions are filtered through filtering paper and the amount of hydrolyzed protein is determined in the filtrate relative to tyrosine. To this end, 2 ml of the filtrate are poured into the test-tubes, whereafter into each of them 5 ml of a 0.5M solution of sodium carbonate and 1 ml of the working Folin's solution are slowly added under continuous stirring, kept in the ultrathermostat (to develop the colour) for 30 minutes at the temperature of 40° C.; then photometric measurements are taken on a photoelectrocolorimeter at a wavelength of 656–677 nm using cells with the distance between the working facets of 5 mm. The reading is taken from the right-hand drum of the instrument.

The optical density of the test solutions is measured relative to the control test (water).

The optical density (D) obtained from the measurement is substituted into the formula for the determination of the proteolytic activity of the enzyme-containing detergent composition:

$$PA=[(4.7\times D+0.1)/n]\times 1{,}000 \text{ units/g}$$

wherein:

PA-proteolytic activity of the enzyme-containing detergent composition;

D-optical density of the enzymatic preparation in 2 ml of the reaction mixture, mg;

4.7 and 0.1-constant coefficients obtained experimentally from the study of the relationship of the degree of protein hydrolysis vs. the enzymatic preparation amount taken for the proteolysis;

1,000-mg-to-g conversion coefficient. Advisable optimum range of optical density of enzymatic preparations is D=0.15–0.35.

For a better understanding of the present invention the following specific examples are given by way of illustration.

EXAMPLE 1

An enzyme-containing detergent composition for presterilization treatment of medical instruments and equipment is prepared, which contains the following components, percent by weight:

sodium dodecylbenzenesulphonate: 4.0
soap: 2.0
sodium tripolyphosphate: 35.0
sodium metasilicate: 20.0
sodium carbonate: 19.0
enzymatic preparation: 0.5
sodium sulphate: the balance.

The enzymatic preparation has the following components, percent by weight:

alkaline protease: 30.0
neutral protease: 45.0
elastase: 5.0
collagenase: 4.0
leucinaminopeptidase: 0.011
carboxypeptidase: 0.15
fibrinolytic enzyme: 1.5
lipase: 2.0
amylase: the balance.

To prepare the enzyme-containing detergent compsition, raw materials are fed into a reactor-mixer by means of automatic metering devices in the following sequence: sodium dodecylbenzenesulphonate-142 kg, soap-91.5 kg, 1,518 kg of water, sodium carbonate-608 kg, sodium sulphate-665 kg, sodium tripolyphosphate-1,120 kg, sodium metasilicate-640 kg. The supply of the components is effected under stirring and upon heating of the mixture to a temperature of 80°–90° C. with hot water circulating within a water jacket of the reactor-mixer. After charging all the components the resulting mass in the amount of 4,800 kg is agitated for additional 10–15 minutes. On completion of agitation the mass is fed from the mixer into a distributing vessel through a system of pipes; from the distributing vessel the mass if fed under pressure to spraying nozzles of drying tower. The drying of the mass is effected in a gas stream according to the "countercurrent" principle at a temperature of 150°–180° C. in the drying zone. The dried powder is delivered onto a belt conveyor through a tapered bottom of the drying tower, then into an ager bin through a system of conveyor mechanisms; from the ager bin the powder is supplied into a drum-type mixer through a feeder and a belt-type weight-metering device.

The enzymatic preparation is simultaneously fed into the same mixer through a dispenser and a belt-type weight-metering device. The amount of the enzymatic preparation is 16 kg. After mixing the enzyme-containing detergent composition in the amount of 3,200 kg with the moisture content of 10% is delivered to the unit for large-volume (bags of 20–25 kg) of small-volume (packages of 500–700 g) packing through a system of conveyor mechanisms.

The enzymatic preparation is produced by submerged cultivation of a strain of the bacterium *Bac.Subtilis* in a liquid nutrient medium containing sources of nitrogen, carbohydrates, phosphorus and necessary additives such as Group B vitamins at the temperature of 37° C. under continuous stirring and aeration for 42–44 hours. Under these conditions accumulation of enzymes takes place therein. On achievement of the maximum of proteolytic activity the fermentation is discontinued. On completion of fermentation the enzymatic preparation is recovered and purified. To this end, from the resulting cultural liquid the biomass is separated by centrifugation and the centrifugate is filtered under sterile conditions. Thereafter, the mother liquor is passed through ultrafiltration membranes. The thus-obtained ultraconcentrate is dried by spraying and shaped into granules of the enzyme-containing detergent composition with a size of 0.2–1.5 mm with the enzyme activity of 50,000–100,000 FOLP units/g.

EXAMPLE 2

An enzyme-containing detergent composition for presterilization treatment of medical instruments and equipment is prepared which contains the following components, percent by weight:

alkylsulphates: 4.0
polyethyleneglycol esters of monoethanolamides of synthetic fatty acids: 2.0
soap: 4.0
sodium tripolyphosphate: 30.0
sodium metasilicate: 25.0
sodium carbonate: 22.0
enzymatic preparation: 1.0
sodium sulphate: the balance.

The enzymatic preparation has the following composition, percent by weight:

alkaline protease: 50.0
neutral protease: 35.0
elastase: 2.5
collagenase: 2.0
leucinaminopeptidase: 0.005
carboxypeptidase: 0.08
fibrinolytic enzyme: 0.75
lipase: 1.0
amylase: the balance.

The enzyme-containing detergent composition is prepared as described in the foregoing Example 1. The amounts of the components are the following: alkylsulphates-365.7 kg; soap-128 kg; polyethyleneglycol esters of monoethanolamides of synthetic fatty acids-65 kg; water-1,240 kg; sodium carbonate-704 kg; sodium sulphate-527 kg; sodium tripolyphosphate-960 kg; sodium metasilicate-720 kg.

The employed amount of the enzymatic preparation is 32 kg, its proteolytic activity is 100,000 FOLP units/g.

EXAMPLE 3

An enzyme-containing detergent composition for presterilization treatment of medical instruments and equipment is prepared which consists of the following components, percent by weight:

sodium alkylbenzenesulphonate: 3.0
monoalkyl ester of polyethyleneglycol based on primary aliphatic alcohols: 2.0
soap: 3.0
sodium tripolyphosphate: 32.0
sodium silicate: 23.0
sodium carbonate: 21.0
enzymatic preparation: 2.0
sodium sulphate: the balance.

The enzymatic preparation has the following composition, percent by weight:

alkaline protease: 60
neutral protease: 27
elastase: 0.01
collagenase: 0.001
leucinaminopeptidase: 0.0001
carboxypeptidase: 0.04
fibrinolytic enzyme: 0.02
lipase: 0.5
amylase: the balance.

The enzyme-containing detergent composition is prepared as described in Example 1 hereinbefore. The amounts of the employed components are the following: sodium alkylbenzene-sulphonate-213.4 kg; monoalkyl ester of polyethyleneglycol based on primary aliphatic alcohols-66.9 kg; soap-137.3 kg; water-1,562 kg; sodium carbonate-672 kg; sodium sulphate-687.3 kg; sodium tripolyphosphate-1,024 kg; sodium silicate-373.3 kg.

The employed amount of the enzymatic preparation is 64 kg, its proteolytic activity is 50,000 FOLP units/g.

EXAMPLE 4

An enzyme-containing detergent composition for presterilization treatment of medical instruments and equipment is prepared which consists of the following components, percent by weight:

sodium dodecylbenzenesulphonate: 5.3
soap: 3.0
sodium tripolyphosphate: 33.0
sodium metasilicate: 20.0
sodium carbonate: 20.0
enzymatic preparation: 2.0
sodium sulphate: the balance.

The enzymatic preparation has the composition described in Example 3 hereinabove.

The enzyme-containing detergent composition is produced by blending. To this end, into a drum-type mixer 206.3 kg of sodium tripolyphosphate, 125.0 kg of sodium carbonate, 36.8 kg of sodium dodecylbenzenesulphonate are charged along with 26.8 kg of a powder-like soap, 92 kg of sodium sulphate and 125 kg of sodium metasilicate. Then the enzymatic preparation is charged into the mixer in the amount of 12.5 kg; its proteolytic activity is 1,000 FOLP units/g. The components are intermixed for 20 minutes. On completion of blending the final product is discharged into a bin by means of a scraper conveyor and the powder is then packed.

All the above-given formulations of enzyme-containing detergent compositions (Examples 1 through 4) ensure complete elimination of protein and fat contaminations from medical instruments and equipment at a temperature of 40°-50° C. under conditions of both manual and machine washing.

The degree of removal of the contaminations is controlled by the ortho-toluidine test.

The enzymatic preparation produced by submerged cultivation of bacteria *Bac.Subtilis* at the temperature of 37° C. for 42–44 hours under continuous aeration has the composition of individual enzymes as described in Examples 1 through 4 hereinbefore.

What is claimed is:

1. An enzyme-containing detergent composition for presterilization treatment of medical instruments and equipment consisting of the following components, percent by weight:

anionic surfactants: 4.0–6.0
sodium phosphate: 30.0–35.0
sodium silicate: 20.0–25.0
sodium carbonate: 19.0–22.0
soap comprising sodium salts of fatty acids: 2.0–4.0
enzymatic preparation: 0.5–2.0
sodium sulphate: the balance, the enzymatic preparation having the following composition, percent by weight:

alkaline protease: 30–60
neutral protease: 27–45
elastase: 0.01–5.00
collagenase: 0.001–4.00
leucinaminopeptidase: 0.0001–0.011
carboxypeptidase: 0.04–0.15
fibrinolytic enzyme: 0.002–1,500
lipase: 0.5–2.0
amylase: the balance.

2. An enzyme-containing detergent composition as claimed in claim 1, wherein non-ionic surfactants are additionally present in an amount of 1–2% by weight of the anionic surfactants.

3. An enzyme-containing detergent composition as claimed in claim 2, wherein as said non-ionic surfactants use is made of a monoalkyl ester of polyethyleneglycol based on primary aliphatic alcohols;
a polyoxyethyleneglycol ester of monoethanolamides of synthetic aliphatic acids.

* * * * *